United States Patent [19]

Longinotti

[11] 4,158,533

[45] Jun. 19, 1979

[54] APPARATUS FOR PRODUCING AND STRIPPING PRESSED CEMENT TILES WITH SUPERIMPOSITION OF A PLURALITY OF STRIPPED TILES

[75] Inventor: Enrico Longinotti, Florence, Italy

[73] Assignee: Longinotti S.p.A., Italy

[21] Appl. No.: 870,521

[22] Filed: Jan. 18, 1978

Related U.S. Application Data

[63] Continuation-in-part of Ser. No. 694,548, Jun. 10, 1976.

[30] Foreign Application Priority Data

Jun. 27, 1975 [IT] Italy ..... 9472 A/75
Jan. 20, 1977 [IT] Italy ..... 9317 A/77

[51] Int. Cl.[2] ..... B28B 13/04

[52] U.S. Cl. ..... 425/139; 425/443; 264/245; 264/333

[58] Field of Search ..... 425/139, 436, 436 R, 425/436 M, 443, 200; 264/245, 333

[56] References Cited

U.S. PATENT DOCUMENTS

| | | | |
|---|---|---|---|
| 2,562,541 | 7/1951 | Flam | 425/139 |
| 3,270,113 | 8/1966 | Longinotti | 264/245 |
| 3,277,522 | 10/1966 | Strauss | 425/436 X |
| 3,804,568 | 4/1974 | Rees | 425/139 |
| 3,904,723 | 9/1975 | Prince | 425/200 X |
| 4,005,973 | 2/1977 | Balhorn | 425/443 |

*Primary Examiner*—J. Howard Flint, Jr.
*Attorney, Agent, or Firm*—McGlew and Tuttle

[57] ABSTRACT

The apparatus produces pressed cement tiles by forming and pressing the tiles in molds and stripping the pressed tiles from the molds. The stripped tiles are deposited, in superimposed relation, on a stripping tray or "shovel" and the thus-supported tiles are subjected to subsequent treatments. A rotary table or platform carries several molds which are cyclically moved through several stages to form and press the tiles, and the tile receiving tray is positioned at a discharge station to have several pressed tiles stripped from the molds and superimposed in a pile on the tray. Alternatively, an intermediate tray is reciprocable radially between a first position, beneath the stripping element, to receive a pressed tile, and a second position retracted from the rotary platform. With this arrangement, a linearly and vertically reciprocable suction arrangement picks up each pressed tile, thus removed from a mold on the rotary platform, and transports it to a tile receiving tray with successive tiles being superimposed in the pile on the tile receiving tray. This tray is mounted for transport through the subsequent treatment stages with the pile of tiles thereon. In another embodiment, a plurality of trays are movable along guideways and, as each tray is aligned with the discharge station of the rotary platform, it is supported on a bracket which is reciprocable radially relative to the rotary platform. As each formed and pressed tile reaches the discharge station, the frame of the mold, carrying the formed tile, is raised and the receiving tray is moved radially in between the frame of the mold and the base of the mold to receive the stripped tile and then it is retracted. This operation is repeated, for each tile-receiving tray, until a predetermined number of stripped tiles has been superimposed on the tile-receiving tray, after which the tray is retracted and moved along the guideways to further tile processing stations.

7 Claims, 26 Drawing Figures

APPARATUS FOR PRODUCING AND STRIPPING PRESSED CEMENT TILES WITH SUPERIMPOSITION OF A PLURALITY OF STRIPPED TILES

CROSS REFERENCE TO RELATED APPLICATION

This application is a continuation-in-part of application Ser. No. 694,548, filed June 10, 1976, for "PROCESS AND EQUIPMENT TO PRODUCE PRESSED TILES OF CEMENT OR THE LIKE, WITH STRIPPING BY SUPERIMPOSITION".

FIELD AND BACKGROUND OF THE INVENTION

In automatic plants for manufacturing tiles, plates or trays are presently used, onto each of which, after the tile pressing stage, a pressed tile is drawn or stripped. After the pressing stage, and during the drawing or stripping of a pressed tile, a plate is extended below the frame containing the pressed tiles, and then the tiles are stripped onto the plates. Subsequently, each plate carrying a freshly pressed tile is placed, together with other similar plates carrying freshly pressed tiles, in drying-out cells for a treatment which is commonly accelerated by means of steam. After the drying out or seasoning, which may last a variable length of time, the plates are removed from the cells with the dried-out pressed tiles thereon. The tiles then undergo successive operations and the plates resume their place in the operational process.

As the number of pressing strokes presently obtainable with an improved press are some thousands during a working shift (for instance, at seven pressing strokes/-minute, there are 3,360 pressing strokes in 8 hours), and since, for each pressing stage, a respective plate is required, a plant requires some thousands of plates or trays. The plates or trays must be positively planar and oxidation resistant, so that their cost is comparatively high. Consequently, the effect of the plate equipment on the cost of a plant is about 20–30% of the overall cost of the particular plant, excluding the cost of the press.

SUMMARY OF THE INVENTION

The objective of the invention is to obtain a very substantial reduction in the cost of the plates or trays required in a tile manufacturing plant.

To this end, the present invention is based upon the concept of superimposing, on a single plate or tray, more tiles on a tray. The plate, on which two, three or more newly pressed and stripped tiles are piled, is then forwarded to the drying-out cell.

In accordance with a first embodiment of the invention, the apparatus for the production of pressed tiles, and which involves the use of molds and stripping means for removing tiles from the mold frames and also plates to receive the stripped tiles, superimposes a plurality of successively stripped tiles on a single plate or tray to form a pile of superimposed pressed tiles, with the plates or trays each carrying a pile of superimposed tiles then being forwarded to the next operations.

The tile-receiving plate is usually moved in a manner to receive the stripped tiles below the mold frames, each of which has been raised, prior to stripping, to the stripping position, and relative to a carrier carrying a plurality of mold bases. In accordance with the first embodiment of the invention, the plate is kept in this position during several successive stripping operations and lowered, after each stripping operation, by the thickness of a tile.

In a further embodiment of the apparatus of the invention, several tiles, stripped successively in a conventional manner and using conventional equipment, and deposited on the surface of a shovel or other conventional means for receiving stripped tiles, are picked up one by one after the stripping operation and laid successively, while still in a fresh state, one upon the other on a tile-receiving plate to form a stack of superimposed stripped tiles, the tiles being then forwarded in the stacked state to the drying-out cell. For this purpose, in addition to the usual stripping equipment, having a shovel insertable under a raised mold frame, the apparatus includes a transfer tool for the fresh tile to remove the same from the shovel to the tile-receiving plate or tray on which several fresh tiles are to be stacked in superposed relation. This tool may be in the form of a sucker or vacuum device with suitable supporting means, and with intermediate fender walings for the tile being lifted by suction.

A third embodiment of apparatus in accordance with the invention is designed to reduce the time required for forming a tile, to keep the plant costs at a low value, and to reduce the sizes of the equipment, especially that of the rotary platform or table, with corresponding reduction in costs. For these purposes, in the third embodiment of the invention, a carriage, with a stripping tray, is moved between a position inserted under a mold frame raised from the mold bottom and a position retracted from the mold or the rotary platform or table carrying the mold, this stripping tray being reciprocated between these two positions a number of times equal to the nunber of tiles to be superimposed on each other on a single tile-receiving tray. A vertically moveable unit or assembly is raisable each time through a controlled distance which is a function of the number of tiles arranged in a pile during previous stripping operations and on the same tray, this vertically moveable unit or assembly being provided to raise a mold frame correspondingly, and the unit can be raised a further distance, which is fixed, for the tile stripping operation.

A pad, which is lowerable for the stripping operation, is provided with a feeler adapted to halt movement of the pad responsive to the presence of the tile to be stripped, no matter at what level the tile then is. Furthermore, consent and control means are provided to obtain, after a mold has reached the stripping position, the raising of the mold frame for the adjusted amount, the insertion of the carriage bracket of shovel under the raised frame, to obtain an optimum stripping condition by falling of the tile or tiles, the lowering of the pad, the stripping, the re-raising of the pad, the retraction of the carriage, and the lowering of the mold frame.

The frame unit or assembly carries a photoelectric cell system, which may be of the type cooperating with a mirror or other reflector means, to evaluate the level of the bearing surface for the tile to be stripped.

A proximity switch is combined with a stripping pad to effect stopping thereof in correspondence with the tile to be stripped, at whatever level this tile is located.

For an understanding of the principles of the invention, reference is made to the following description of typical embodiments thereof as illustrated in the accompanying drawings.

DESCRIPTION OF THE PREFERRED EMBODIMENTS

Figure 1:
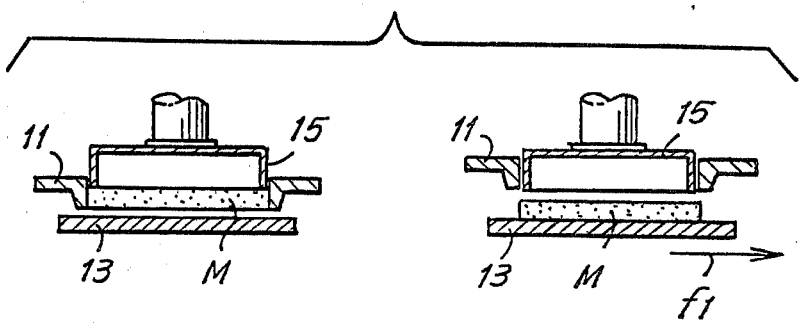
FIG. 1 illustrates the two stages of a stripping operation in accordance with conventional practice.

Referring to the conventional tile stripping system shown in FIG. 1, the mold frame 11 after the tile pressing stage, is raised with respect to the mold bottom so that the tile M remains within the frame. A shovel, with a plate or tray 13, or other receiving member, for the stripped tile, is inserted immediately below the frame 11 and then stripping is effected with the aid of a stripping pad 15 which effects stripping of tile M by the effect of the relative vertical motion thereof with respect to the frame 11. In practice, during the stripping operation, the pad 15 remains stationary and the frame 11 is raised, while the released tile rests on the plate 13 or the like. This plate or tray is then moved away in the direction of the arrow f1.

In accordance with a first embodiment of the invention, after the inital stripping operation on the plate 13, the plate 13, together with the shovel, is not moved away but merely lowered, in such a manner that the upper surface of the initially stripped tile M1 serves to receive the second tile M2 which is stripped from the subsequent mold frame 11 arriving at the stripping station. The operation may be continued by superimposing, onto the two tiles M1 and M2, a third tile M3 subsequently stripped, by previously further lowering plate 13. The operation can be extended further for stripping a fourth tile M4, with provision being made for a controlled lowering of the shovel and the plate or tray 13 at each subsequent stripping, or a lowering can be effected directly by a downwardly directed movement of the stripping pad 15. After a predetermined number of strippings, and thus of superimpositions, of new tiles, plate 13 is retracted in the direction of the arrow f1 to be forwarded to the subsequent handling of the tiles, for instance, to the drying-out cells. The controls are mostly of the hydraulic type.

FIG. 3-6 show, very diagrammatically and substantially only illustrative, the application of a first embodiment of the invention to a rotary seven-stations press, including a rotary table or platform 17 which successively steps, to the seven stations "1" through "7", each of the seven molds on rotary table 17. Each mold includes a respective bottom 19 and a respective frame 21, similar to the frame 11, and which can be raised and lowered, for example by means of a vertically oriented, hydraulic cylinder-piston system 23. On a stationary structure 24 at the stripping station "7", there is mounted a stripping pad 25, corresponding to the stripping pad 15, operated by a cylinder-piston system 26,26A for a preliminary lowering thereof as controlled by a limit switch 25A which feels or senses the tile to be stripped.

In station "1" frame 21 is lowered onto mold bottom 19 and the first layer of mortar is loaded into the mold 21-19. In station "2", vibration of the mortar is effected and, in station "3", the second layer of material is distributed into the mold. In station "4", a first pressing, or preliminary pressing is effected and, in station "5", a second pressing is effected, the second pressing being effected with a press 27 of conventional construction. In station "6", and with reference to FIG. 4, there is effected the lifting of mold frame 21, from its engagement with mold bottom 19, to the raised position, shown in FIG. 4. In the stripping station "7", besides the stationary structure 24, there is provided a moveable carriage 29 which is moveable along guides 31 oriented radially with respect to rotary table or platform 17.

Figure 2:
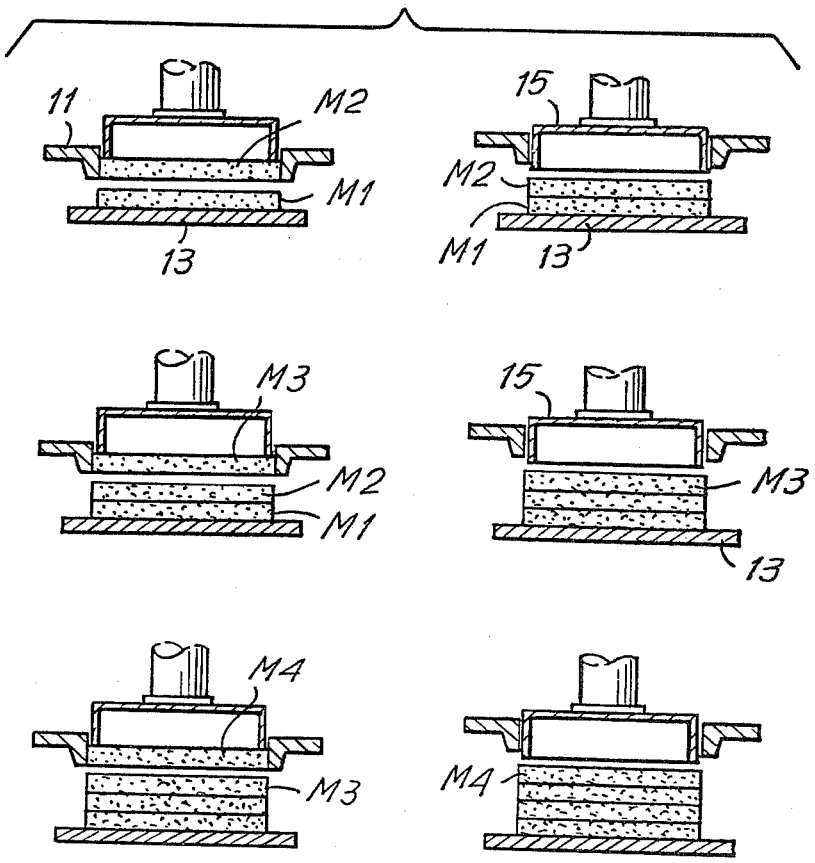
FIG. 2 illustrates three stripping stages in accordance with a first embodiment of the invention.
Figure 4:
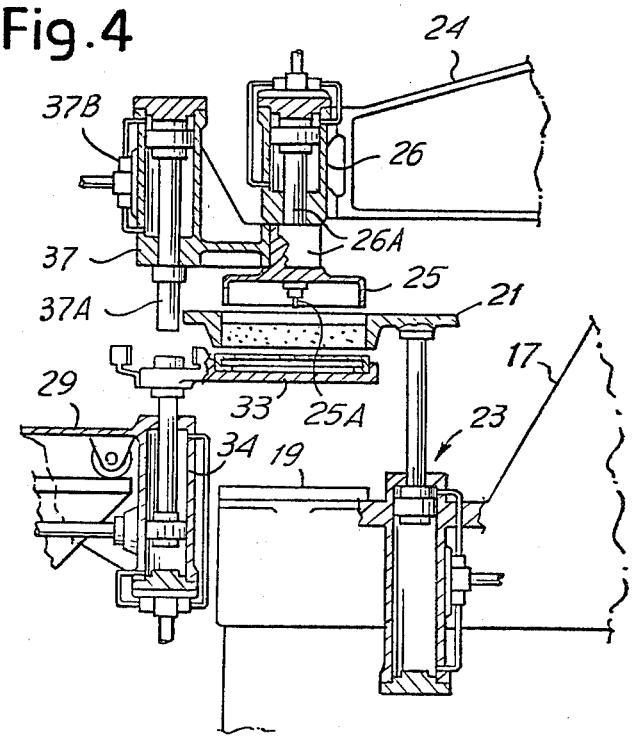
FIG. 4 is sectional view taken along the line IV-V of FIG. 3 illustrating lifting of a mold frame with the means to receive the stripped tiles shown in the fully raised position.
Figure 5:
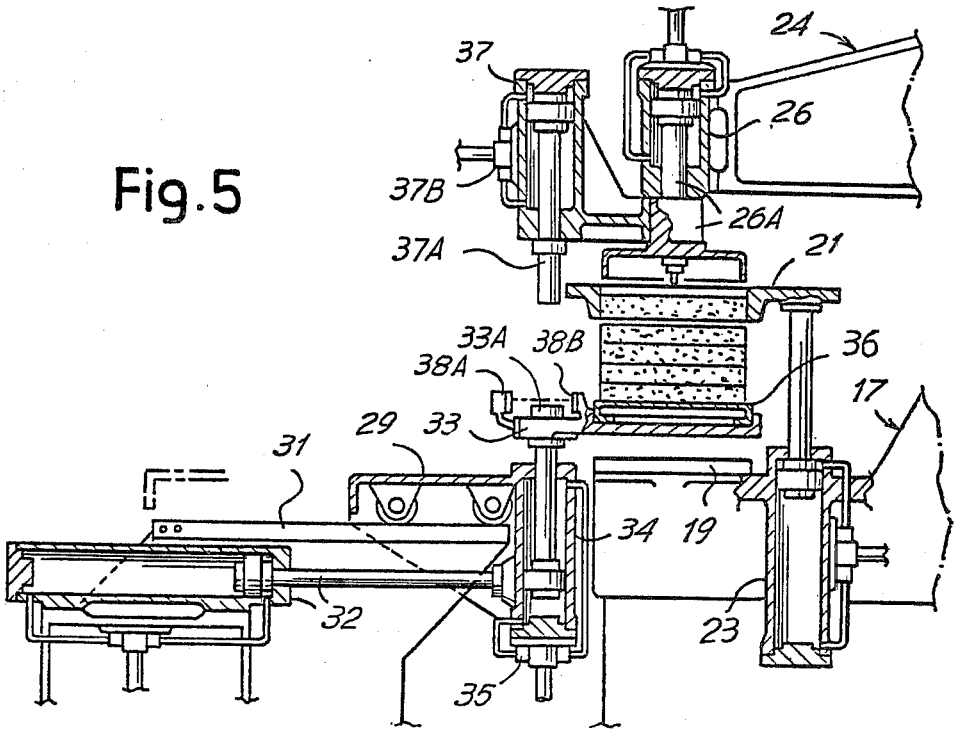
FIG. 5 is a sectional view, also taken along the line IV-V of FIG. 3, showing subsequent tile strippings with the superimposition of the stripped tiles.
Figure 6:
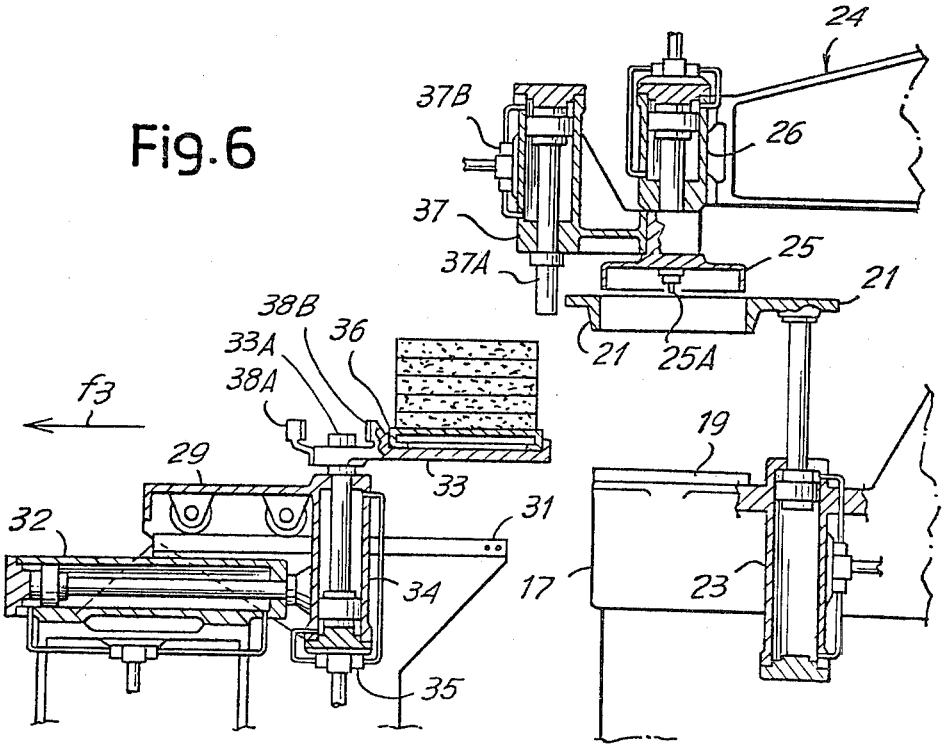
FIG. 6 is a sectional view, similar to FIGS. 4 and 5, illustrating a separation stage in which the collecting means for receiving the superimposed stripped tiles is retracted from its tile-receiving position.

Carriage 29 is displaced along guides 31 by a horizontally oriented fluid pressure actuator, such a cylinder-piston system 32. Carriage 29 carries a shovel member 33 which is reciprocable vertically relative to carriage 29 by means of a vertically oriented cylinder-piston system 34. System 34 includes a control 35 designed to cause lifting of shovel 33, besides being designed to allow a series of partial lowerings of shovel 33 after an external action, and a consequent stopping of shovel 33 at each attained level. Shovel 33 carries a plate or tray 36, corresponding to the plate 13 of FIGS. 1 and 2. When carriage 29 is brought close to the press, as shown in FIGS. 4 and 5, plate or tray 36 is brought under mold frame 21, then in station "7", which mold frame is raised, while, after retraction of carriage 29 in the direction of the arrow f3, shown in FIG. 6, plate or tray 36 with several stripped and superimposed tiles may be picked up. In the tile reception position shown in FIGS. 4 and 5, the unit 33,36 is progressively lowered step by step. For this purpose, a cylinder-piston system 37 is provided in the moveable portion 26A of cylinder-piston system 26,26A. Moveable member 37A of system 37 is designed to act on a stop 33A of shovel 33. A hydraulic control member 37B of system 37 causes lowering of moveable section 37A, after the limit switch 25A has halted lowering of portion 26A. This lowering is interrupted when the lower end of member 37A reaches a light pencil or beam of a photoelectric cell system 38A-38B slightly above top 33, irrespective of the level previously reached by member 37A. Member 37A is thus locked closely above stop 33A, and determines an additional lowering of shovel 33 as soon as the unit 26A-37 is lowered during the stripping stroke. Upon raising of section 26A, member 37A is also raised with respect to the cylinder of the system 37.

After the second pressing stage "5", in the subsequent stationary stage "6", frame 21 is prepared for stripping by being lifted as high as required so as not to interfere with the size of the members located in the subsequent stripping station "7". In station "7" frame 21 arrives in a raised position and finds shovel 33 ready to receive the stripped tiles. Shovel 33 remains in the stripping position during stripping of the desired or predetermined number of tiles to be superimposed on plate or tray 36. At each stripping of a tile onto shovel 33, the latter is lowered by the added thickness corresponding to that of the stripped tile. FIG. 4 shows the level reached by the shovel 33 at the start, while the following FIG. 5 shows the arrangement after four successive stripping. Before each stripping, member 37A determines an additional lowering of shovel 33 and of the already stripped tiles. After completing the strippings and the superimpositions as above, shovel 33 is retracted, in the direction of the arrow f3 to permit plate or tray 36, with the superimposed tiles, to be unloaded.

The system just described provides a very substantial saving in time. Thus, shovel 33 no longer is required to make reciprocable motions toward and away from the rotary table or platform 17 for each pressing operation, as is necessary in conventional tile forming machines, but only one reciprocating motion for every three, four, or more pressing operations. Additionally, and owing to the superimposition of stripped tiles, there is obtained a substantial saving of the plates or trays 36, equal to the number of pressing operations during a full path of travel of a plate divided by the number of the superimposed tiles, and there is also obtained a higher speed from one pressing operation to the next due to the smaller number of movements to be effected. A further very substantial advantage is a reduction in the size of the drying-out of seasoning cells.

Figure 3:
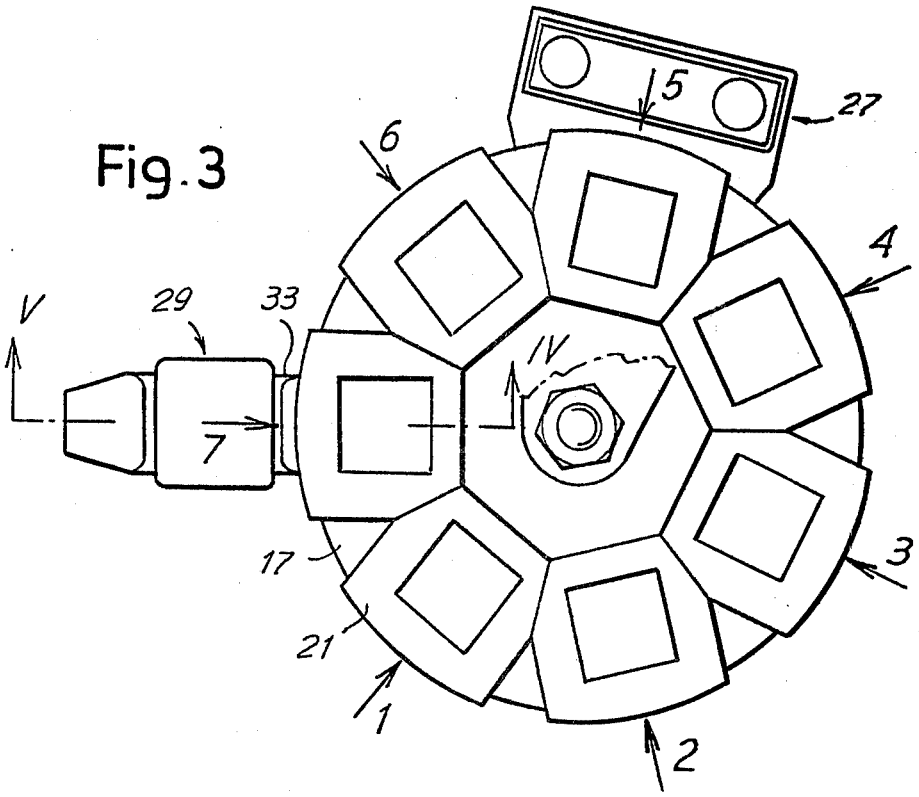
FIG. 3 is a somewhat diagrammatic plan view of a circular tile press for practicing the invention.

Two pressing operations are effected in machines embodying the invention, as can be seen from FIG. 3. In fact, although there is obtained a quicker overall cycle, it is necessary not to reduce the pressing time which is related to the natural speed of absorption of the moisture from the first semi-dense layer desposited in a mold to the nearly dry second layer. This is obtained by pressing twice, in two successive stations.

The tile producing process is suited to the requirements which can be set beforehand, especially for increasing the number of superimpositions of stripped tiles. In paarticular, an operator can select the inert materials and the gradings in order to increase the consistency of the tiles after the pressing, higher specific pressures can be applied, and the mechanics of the stripping in the press may undergo change, considering that, for example, in a cycle of three strippings on the same plate, each time the plate or the frame may assume a different position in height, or a different level, in order to accommodate the already drawn or stripped tiles present on the plate or tray.

Besides the direct and apparent saving resulting from the smaller number of plates used in the plant, there is obtained a further saving due to the fewer number of movements in consequence of the smaller number of plates. It may also be provided, especially in the case of presses with multi-mold frames, to move the plates directly, without stacking the plates in transport carriages.

Figure 7:
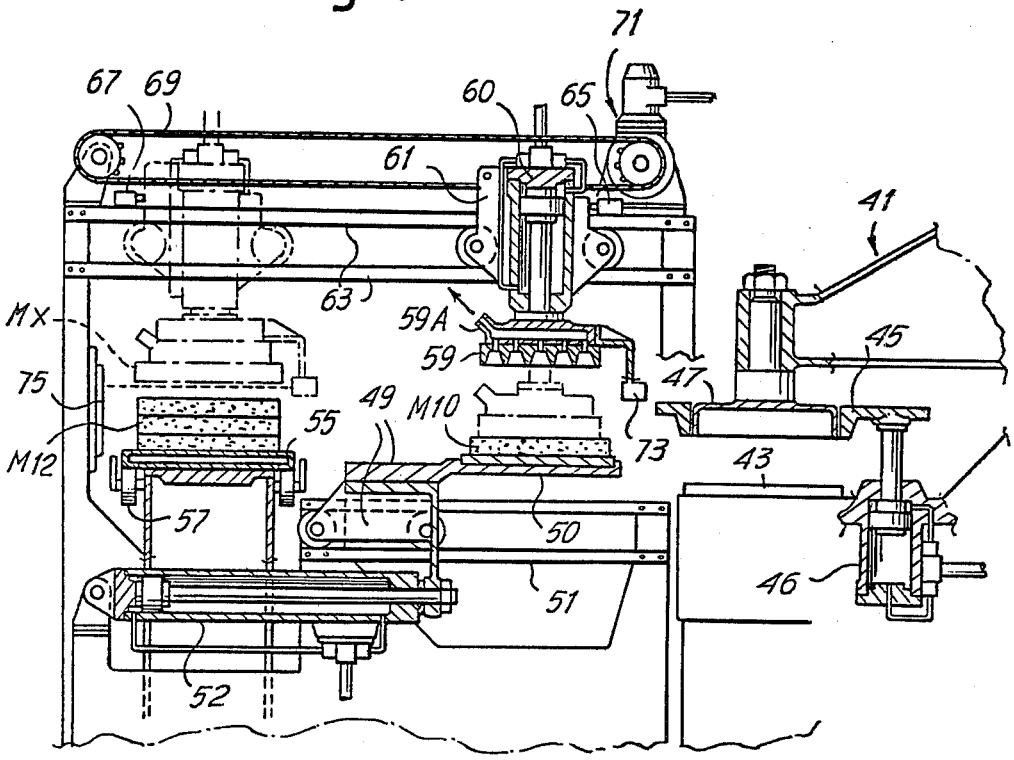
FIG. 7 is a sectional view illustrating the superimposition of stripped tiles in accordance with a second embodiment of the invention.

FIG. 7 shows a second embodiment of the invention, applicable to conventional existing presses, but without, however, introducing structural complications in the molding press. In accordance with the embodiment of the invention shown in FIG. 7, the newly pressed tiles are stripped one by one, picked up, and then laid on the pile of tiles being formed of superimposed tiles on the plates passing in front of the shovel. In this embodiment of the invention, the tiles are stripped onto the shovel of a conventional press, are picked up therefrom, and are transported to and laid onto the plate or tray which remains stationary in front of the shovel during the time required for the superimposition of tiles to form a pile thereon.

Referring to FIG. 7, a rotary table or platform 41, similar to that shown in plan in FIG. 3, carries the bottoms 43 of a number of molds and the respective frames 45 which are raisable for stripping by means of cylinder-pistons 46. The stripping pad 47 is located in the stripping station to cooperate with frame 45 when the latter is raised twice. A carriage 49 supports a shovel 50 designed to receive a stripped tile M10, and carriage 49 is reciprocable on ways 51 and is reciprocated by a hydraulic piston-cylinder system 52.

When carriage 49 is moved along ways or guides 51 under the raised frame 45, shovel 50 is slightly below the mold frame to receive the tile displaced by the stripping pad 47. After the stripping of a tile, carriage 49, with shovel 51 bearing the just stripped tile M10, is moved outwardly into the position shown in FIG. 7 and in which the tile M10 is picked up and laid on a plate or tray 55 then stationary on rails 57. One or more piles of newly stripped tiles M12 are thus formed on plate or tray 55. The pick-up and transfer of the tiles is effected with a sucker or vacuum device 59 reciprocated vertically by a cylinder gas piston system 60, so as to be raised and lowered relative to a carriage 61. Carriage 61 is horizontally reciprocable along guide 63 from the pick-up position, shown in full lines in the drawing, to the laying-down position on tray 55 to form the pile, as indicated in dot and dash lines in FIG. 7. These two positions are defined by respective stops 65 and 67, and carriage 61 is controlled, in the embodiment of FIG. 7, by a chain 69 operated by a reversing reduction gear 71 connected to a suitable driving means.

In accordance with the presence of a different number of thickness of tiles M12, in the pile being formed in plate or tray 55, the lowering of sucker or vacuum device 59 must be adjusted to lay each newly superimposed tile at the correct level. In order to effect this, there is provided, on the sucker moveable unit, a photoelectric cell finder 73 designed to cooperate with a reflecting surface 75. The ray or beam of cell 73 is immediately below the tile Mx carried by sucker 59, and is intercepted by the upper tile of the tile being formed on the plate or tray 55, thus determining the limit of the lowering of sucker 59. Sucker 59 is constructed in such a manner as to afford adjacent supports, like fender walings, for the tile retained thereon by suction. The sucker is connected, at 59A, to a vacuum source with a control valve for the pick-up and release of the tile.

With the system shown in FIG. 7, the stripping system remains conventional and the extra equipment 63, 61, and 59 is added.

Figure 8:
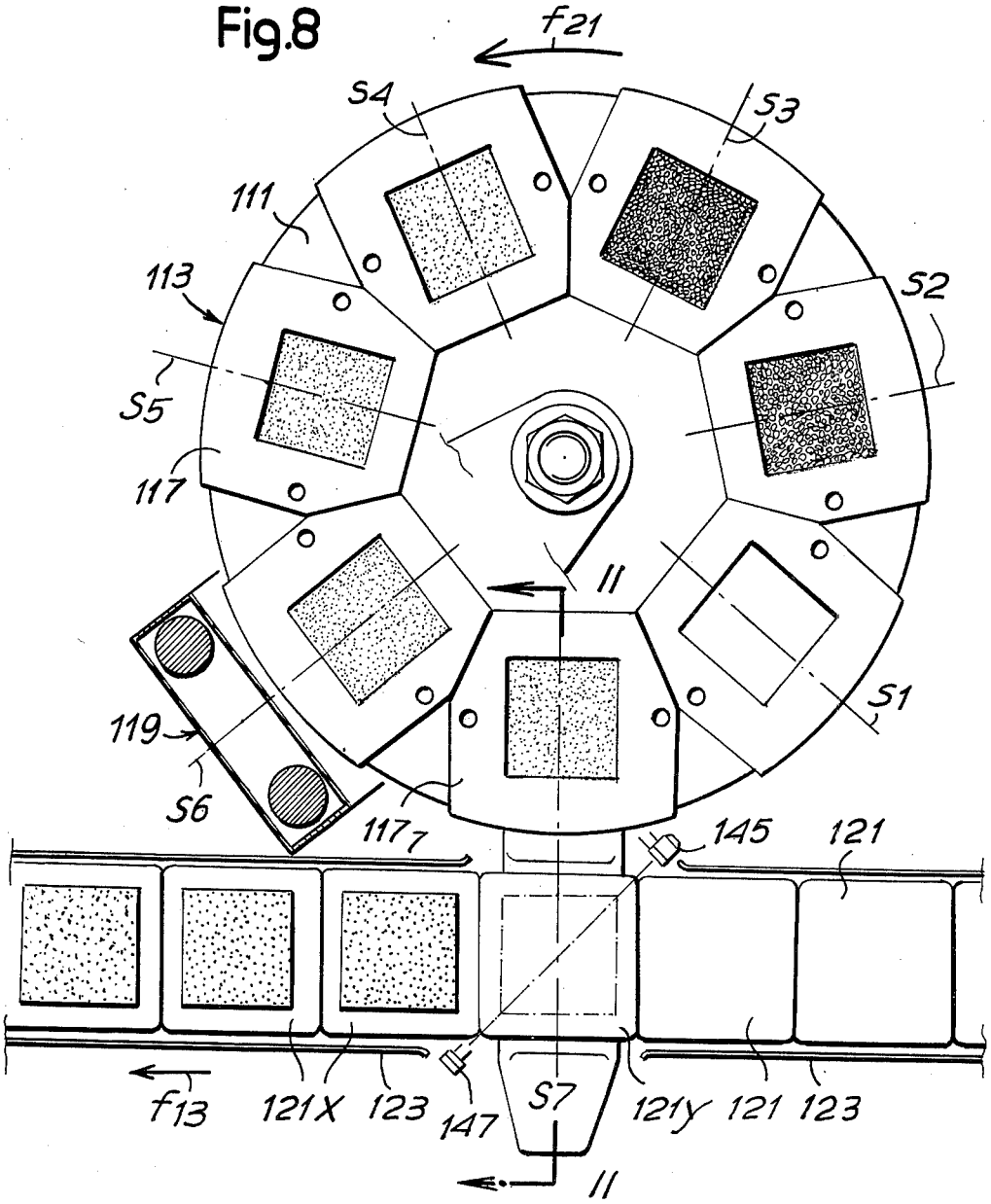
FIG. 8 is a schematic plan view of a tile press and associated equipment in accordance with a third embodiment of the invention.

FIGS. 8–17A disclose a third embodiment of the invention. As best seen in FIG. 8, a rotary table or platform 111 carries a plurality of molds generally designated 113 and distribued uniformly around the periphery of table 111. Each mold includes a bottom 115 and a frame 117 that rests on the elastic sealing surface of bottom 115 to define the mold cavity, which latter can be single or multiple according to the sizes of the tiles to be formed. The drawings illustrate a frame that forms a single tile of large size.

Table 111 is advanced angularly, by steps, to cause each mold 113 thereon to assume seven positions designated S1, S2, S3, S4, S5, S6, and S7, in which the several manufacturing stages take place. In particular, in station S1, the mold 113 is cleaned, in station S2, the loading of a first layer of material into the mold is effected to form a tile, in station S3, the mold is vibrated, in station S4, a possible and advantageous second layer of material is loaded into the mold, in station S5, residues and debris are sucked out, in station S6, pressing is effected by a press generally designated 119, and, in station S7, the finished tile is stripped. Stripping takes place on a tray, which is brought under a raised frame and then removed from that position to be forwarded to further workings. The apparatus shown in FIGS. 8–17A, allows the superimposition on the same tray of several tiles, to very substantially reduce the number of trays required.

In FIG. 8, 121 designates trays to be brought successively to station S7 beneath frame $117_7$, located in stripping station S7, while 121X designates trays that have already received a given number of stripped tiles, in superimposed relation thereon, and which are then forwarded in the direction of arrow f13 along an advance track 123 toward the further treatment stages, for seasoning and the like. The superimposition of a plurality of tiles on the same tray 121 provides particular economic advantages, as it reduces the number of trays in relation to the number of tiles that are superimposed on the same tray, which leads to a substantial economy in the cost of the plant. The embodiment of the invention shown in FIGS. 8–17A permits this superimposition and further permits obtaining the superimposition of the stripped tiles with a substantial simplification in the movement of the several components, so as to reduce the times and spaces necessary to obtain the different movements, thus also limiting the cost with respect to the sizes of the table or platform 111 of the pressing machine.

As best seen in FIGS. 9–17A, a bracket 127 is provided on the stationary structure 125 of the apparatus, in a correspondence with stripping station S7 and carries sliding guides 129 for a carriage 131 which is thus capable of reciprocating radially relative to platform or table 111. Carriage 131 has a bracket 131A which projects towards table or platform 111 and which can receive a tray 121. Such a tray is located in the position denoted **121*y* when carriage 131 is fully retracted radially outwardly relative to table 111, that is, in the position shown in FIGS. 9, 10, 15 and 16, wherein bracket 131A is aligned with advance guides 123 so as to receive a tray 121 located in position 121*y*. This tray, in the position 121*y*, carried by bracket 131A, can then be displaced from the position shown in FIG. 10 to the position shown in FIG. 11, to receive a tile that is stripped directly onto tray 121*y* or onto a tile or a pile of tiles which have been previously stripped onto the same tray in a manner described hereinafter. Reciprocation of carriage 131, on the structure 125,127, is effected by a cylinder 133 of a cylinder-piston system whose piston 135 is connected with a piston rod 135A in turn connected with carriage 131**.

At stripping station S7, means are provided to cause the raising of a mold frame 117 that has reached the stripping station, as well as means to cause the stripping of tile from the raised frame, for plate stripping of the tile from the raised frame 117 onto tray **121*y* or onto the pile of previously stripped tiles already on tray 121*y*. The raising means for frame 117 are adjusted to cause a raising of the frame as a function of the presence of tiles already stripped onto tray 121*y*. The stripping means are lowered, to reach the tile to be stripped, irrespective of the particular raised level of the frame 117**, and means are then operative to cause a relative movement for the stripping, especially through a further incremental raising of the frame with respect to the stripping means.

More particularly, in the stationary structure 125 and under stripping station S7, a cylinder-piston system is provided including a vertically oriented cylinder 137 and a piston 139 whose stem 139A carries, at its upper end, a plate 141 that can be moved vertically by the system 137, 139. Plate 141 has secured thereto an arm 143 with a photoelectric system 145 including a photoelectric cell and a related light source, which are designed to cooperate with a mirror surface or reflector surface 147 extending vertically and preferably carried by the stationary structure 127. Considered horizontally, the photoelectric system acts diagonally relative to the position that a tray **121*y* takes on bracket 131A before being brought under a frame 117** raised for the stripping of a tile.

Each frame 117 of a respective mold 113 is provided with an appropriate number of downwardly directed stems 149 that can slide vertically relative to the bottom 115 of the respective mold and through a suitable relative wide seat of table 111, the lower ends of stems 149 being adapted to be engaged and raised by plate 141 after the respective mold has been brought to the stripping station S7 and one plate 141 is raised by cylinder-piston system 137, 139. The amount of raising of plate 141, and thus of frame 117 of a mold located in stripping station S7, is controlled by photoelectric system 145,147 in such a manner that raising of frame 117 is halted when the photoelectric cell of system 145 receives a beam reflected by reflecting surface 147. This beam is intercepted both by the structure including carriage 131 and bracket 131A, the relative tray **121*y*, and the tiles previously stripped and deposited onto tray 121*y*, such as the conditions designated by M21, in FIG. 9, M23 in FIGS. 15, 16 and 17, and so on. In effect, the raising of frame 117 is proportioned to the absence or presence of one or more previously stripped tiles, such as the tiles M21, M23–M25 which are already superimposed on tray 121*y* carried by bracket 131A of stripping carriage 131. The raising of frame 117 in stripping station S7 is such that the assembly of carriage 131, bracket 131A, and the tiles stripped and superimposed on tray 121*y*, can be inserted directly under raised frame 117, so that a very small space remains between the lower surface of raised frame 117 and the surface designed to receive the tile newly stripped from frame 117. This surface can be that of tray 121*y* or the upper surface of the last of the tiles which have been already stripped and superimposed onto tray 121*y*. By this arrangement, when the new tile is tripped from raised frame 117, which stripping is effected by a further incremental raising of frame 117 and with an appropriate stripping pad described hereinafter, the free fall, of the tile just stripped, onto the surface designed to receive it, of the assembly including carriage 131, is the minimum necessary to ensure clearance for movement of carriage 131** and the parts connected therewith.

On an upper part 125A of stationary structure 125, and in correspondence with stripping station S7, a stripping pad 151 is provided and is adapted to act peripherally on a tile M20 to be stripped from frame 117, with an already known arrangement. Through the medium of the small table 153, stripping pad 151 is carried by a unit or assembly moveable vertically relative to structure 125A, and including a plate 155 which is moveable horizontally to be centered exactly relative to raised frame 117, with the aid of guide pins 156 received in corresponding seats of raised frame 117. Plate 155 is carried by stem or piston rod 157A of a piston 157 of a cylinder-piston system whose cylinder 159 is mounted on structure 125A to provide for raising and lowering of pad 151.

Figure 12A:
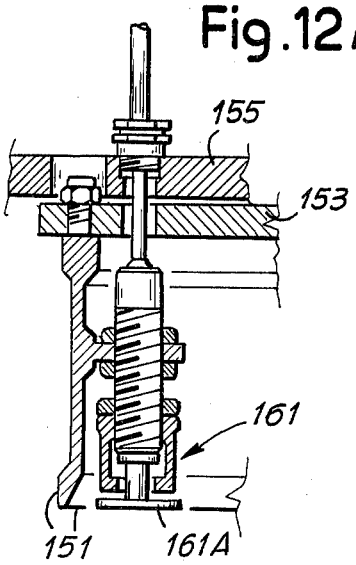
Figure 12:
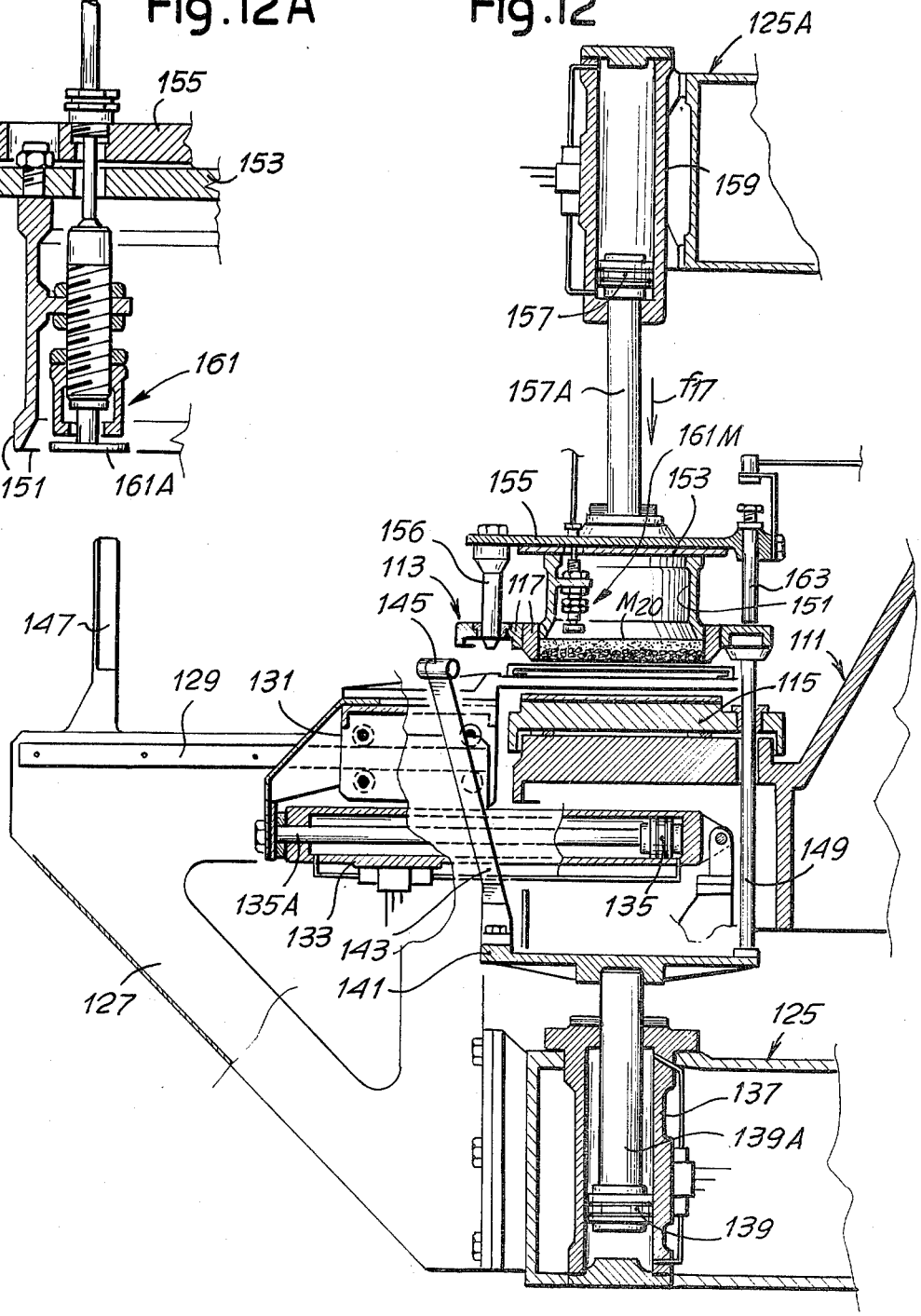

The raising and lowering unit, including members 151, 153 and 155, is provided with proximity switch 161 whose feeler 161A can engage the tile M20 to be stripped, and raised, together with frame 117, to effect stopping of the lowering movement of unit 157, 157A, 155, 151 when stripping pad 151 has reached, or almost reached the tile M20 to be stripped, during the lowering stroke indicated by the arrow f17 of FIG. 12. Plate 155 also has a feeler 163 slidably mounted and supported by plate 155 and capable of being raised, relative to plate 155, by frame 117, to determine a consent or an actuation for a stage following the stripping stage, in the manner and for the purposes mentioned hereinafter.

The arrangement operates as follows. A mold which, with an advance in the direction of arrow f21 of table 111, reaches stripping station S7, has its frame 117 lowered onto its bottom 115 under the conditions shown in FIG. 9, while carriage 131 is located in the retracted position, that is, moved away from table 111, by virtue of a control operated by system 133, 135. This retracted position of carriage 131 is reached, at each cycle of angular advance of table 111. When the rotary table has stopped, the cylinder-piston system 137,139 is actuated to effected raising of plate 141 and thus of frame 117 with the tile M20 to be stripped, to a level that is established by photoelectric system 145, as a function of the presence, on carriage 131, of either only tray **121*y*** or of one or more tiles M23,–M25 which have previously been stripped.

Figure 9A:
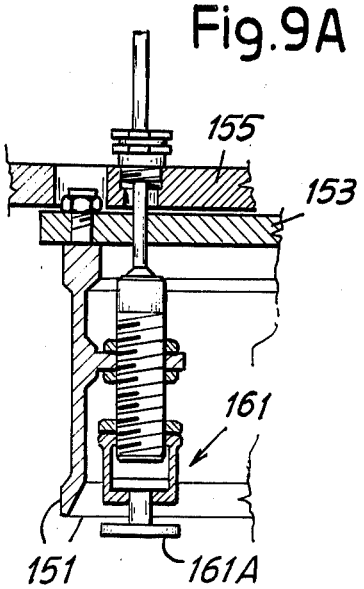
FIG. 9A is a sectional view of an enlarged detail of FIG. 9.
Figure 9:
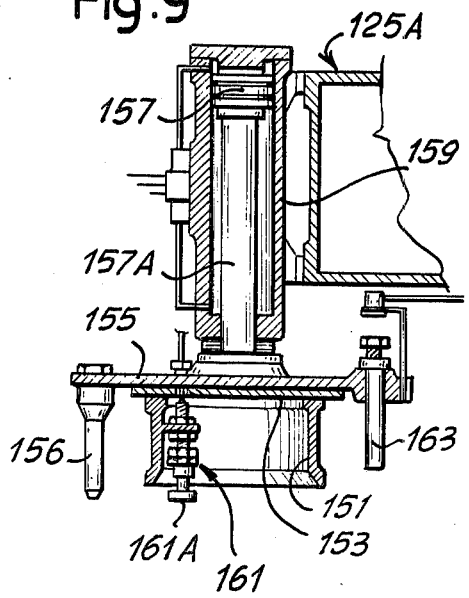
FIG. 9 is an enlarged sectional view taken on the line IX—IX of FIG. 8.
Figure 9:
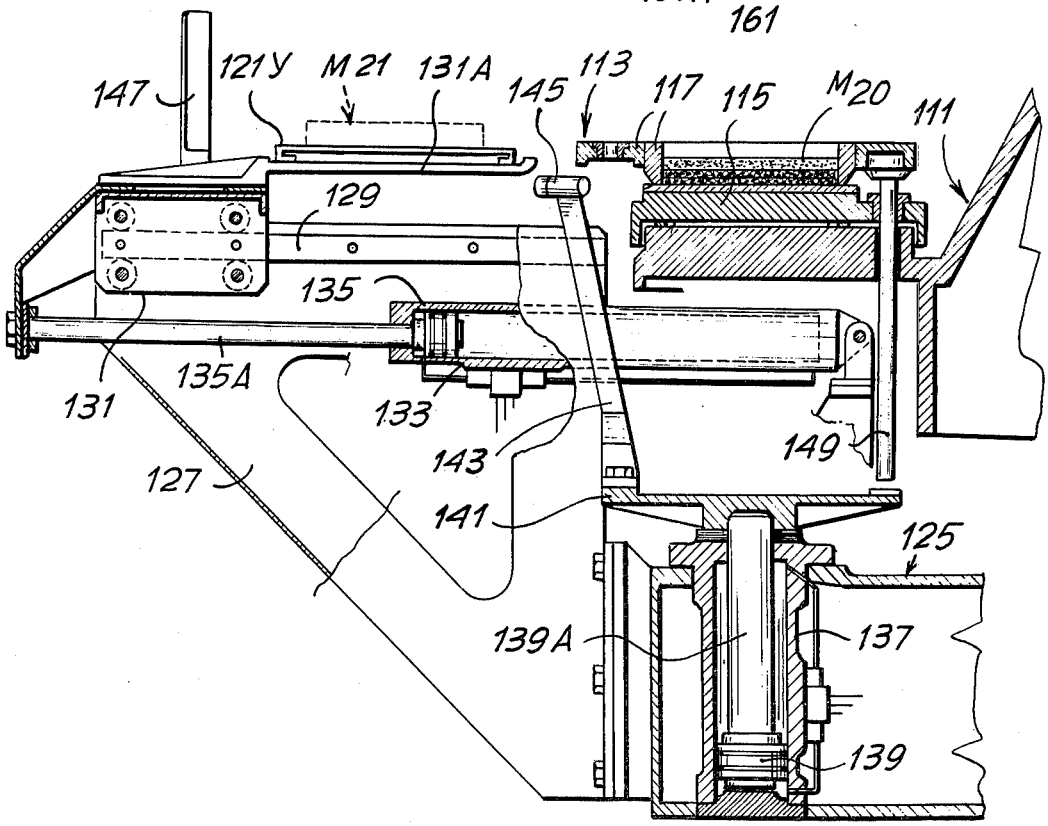
Figure 10A:
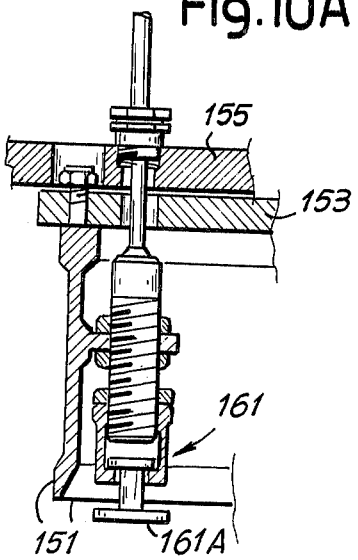
FIGS. 10 and 10A, 11 and 11A, 12 and 12A, 13 and 13A, 14 and 14A, 15 and 15A, 16 and 16A, and 17 and 17A are sectional views corresponding to FIGS. 9 and 9A illustrating the different positions of the apparatus during successive stages of a cycle.
Figure 10:
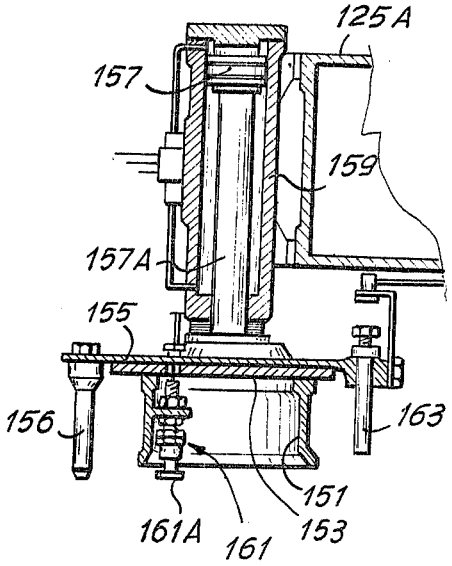
Figure 10:
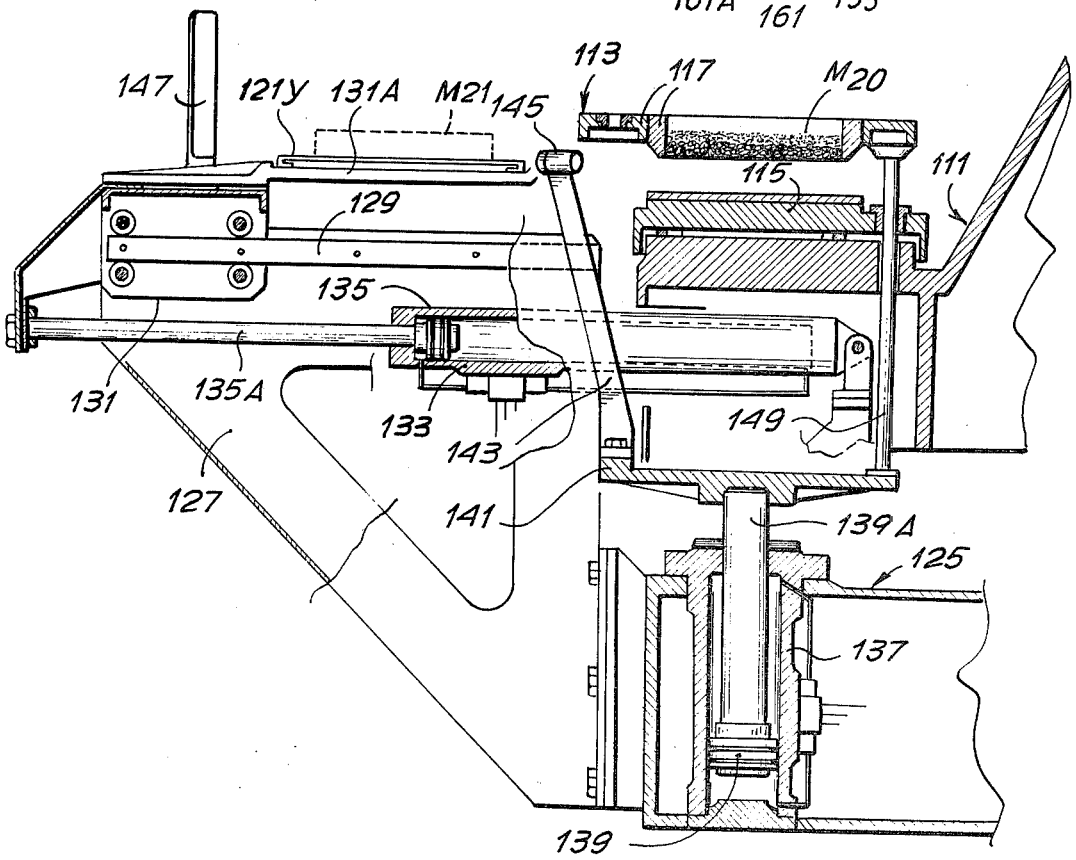
Figure 11A:
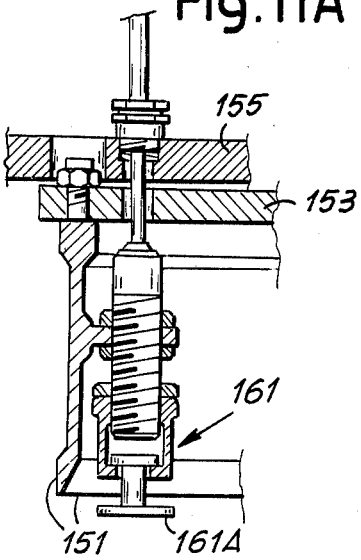
Figure 11:
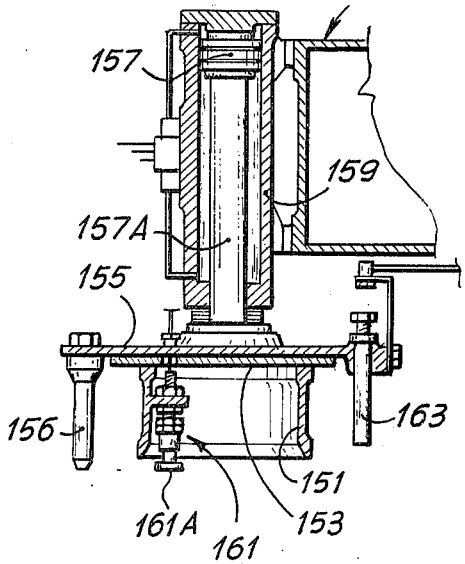
Figure 11:
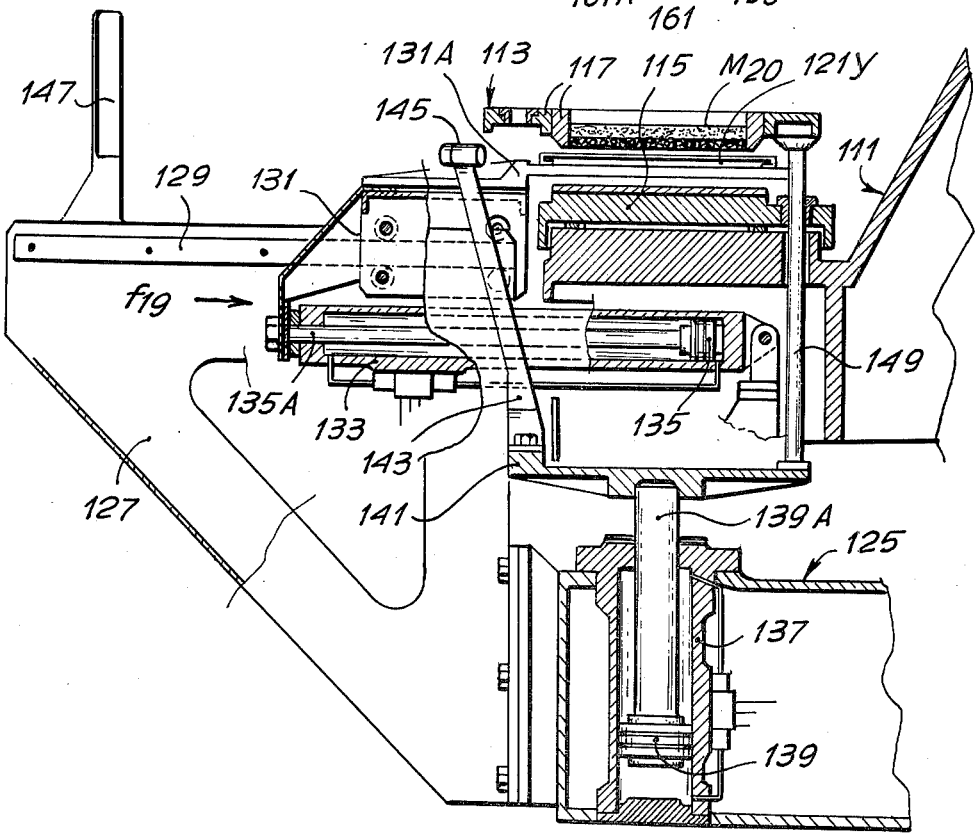

In particular, Fig. 9 shows the condition in which tray **121*y* does not carry any tiles. Raising of plate 141, and thus of frame 117, is thus interrupted under the conditions shown in FIG. 10, that is, when the light beam of the photoelectric system grazes the upper surface of tray 121*y* without being interrupted, and being thus reflected by reflector system 147. When this position of frame 117 has been reached, as shown in FIG. 10, carriage 131 is advanced, in the direction of arrow f19 of FIG. 11, until bracket 131A with tray 121*y* is inserted between bottom 115 of the mold in the stripping station and the frame 117 thereof, and which has been raised only the minimum amount necessary to allow the insertion of bracket 131A and tray 121*y* without tiles. The condition of the parts is then shown in FIG. 11**.

Immediately afterwards, the asembly 157, 155, 151 is lowered onto pad 151, with plate 155 centered on frame 117 through the medium of the pins 156, and until feeler 161A, during such lowering, slightly rests on tile M20 to be stripped. This resting of feeler 161A on the tile actuates proximity switch 161, which acts to interrupt lowering of stripping pad unit 151 in the direction indicated by arrow f17, so that stripping pad 151 is thus almost in contact with tile M20, as best seen in FIG. 12.

Figure 13A:
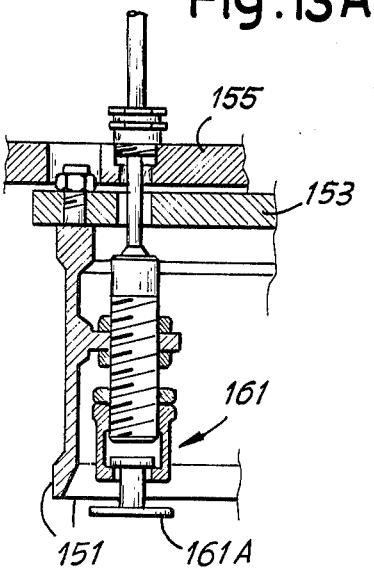
Figure 13:
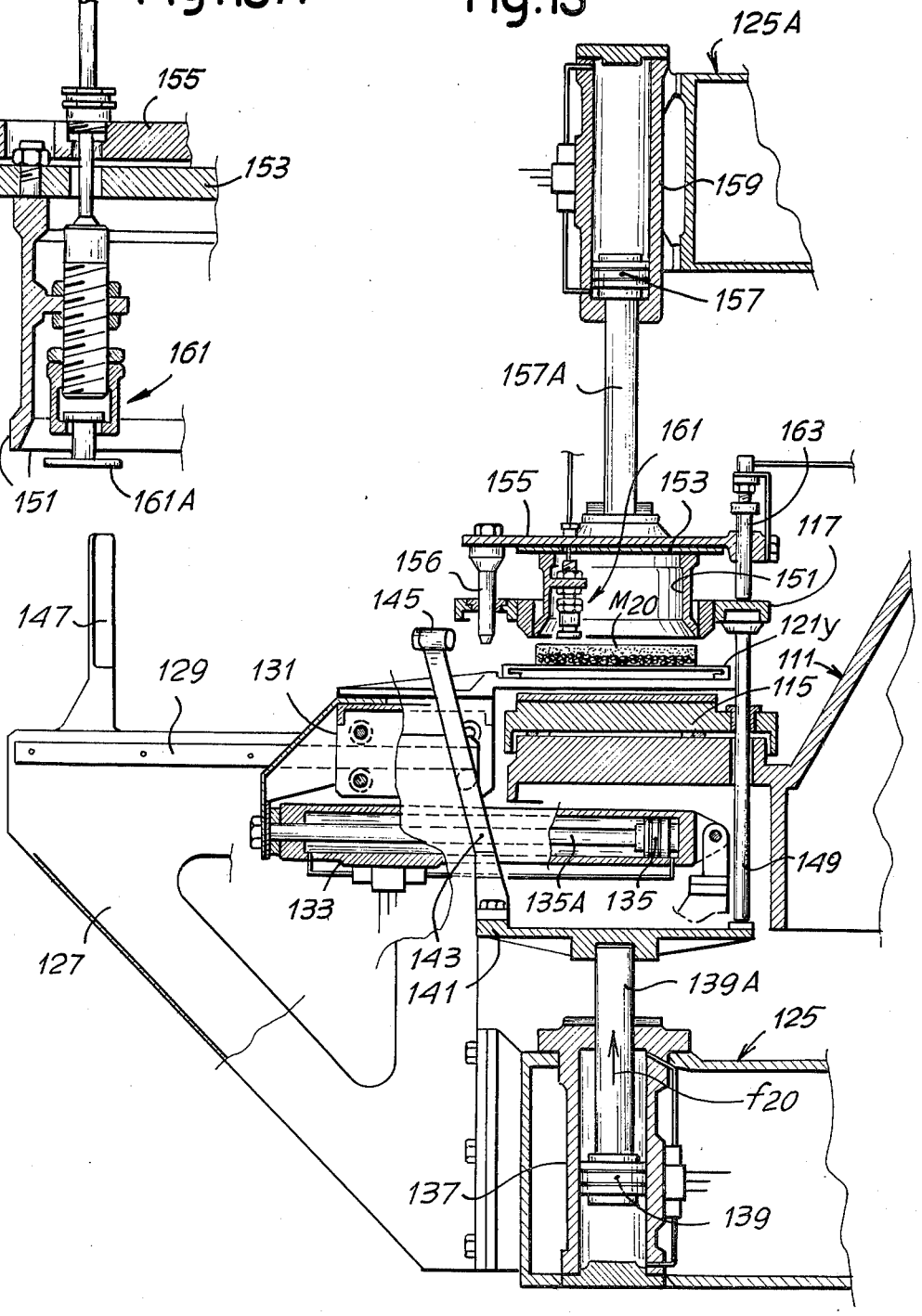
Figure 14A:
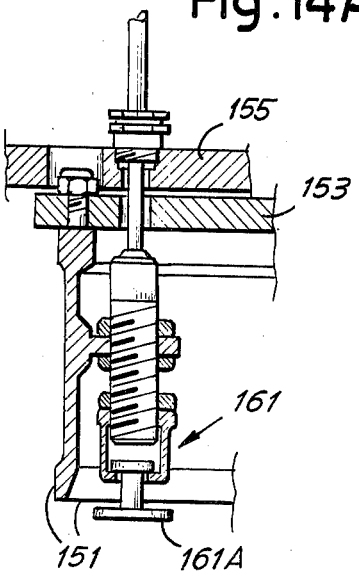
Figure 14:
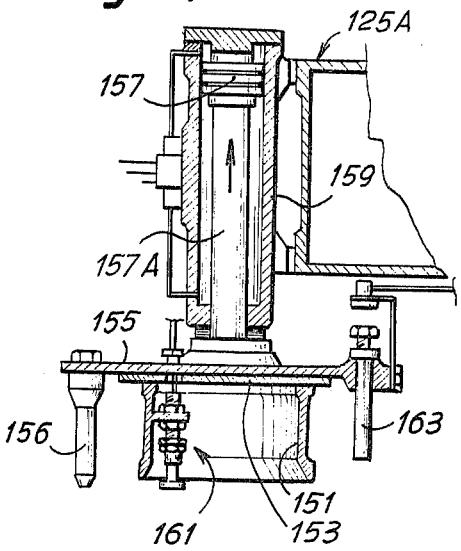
Figure 14:
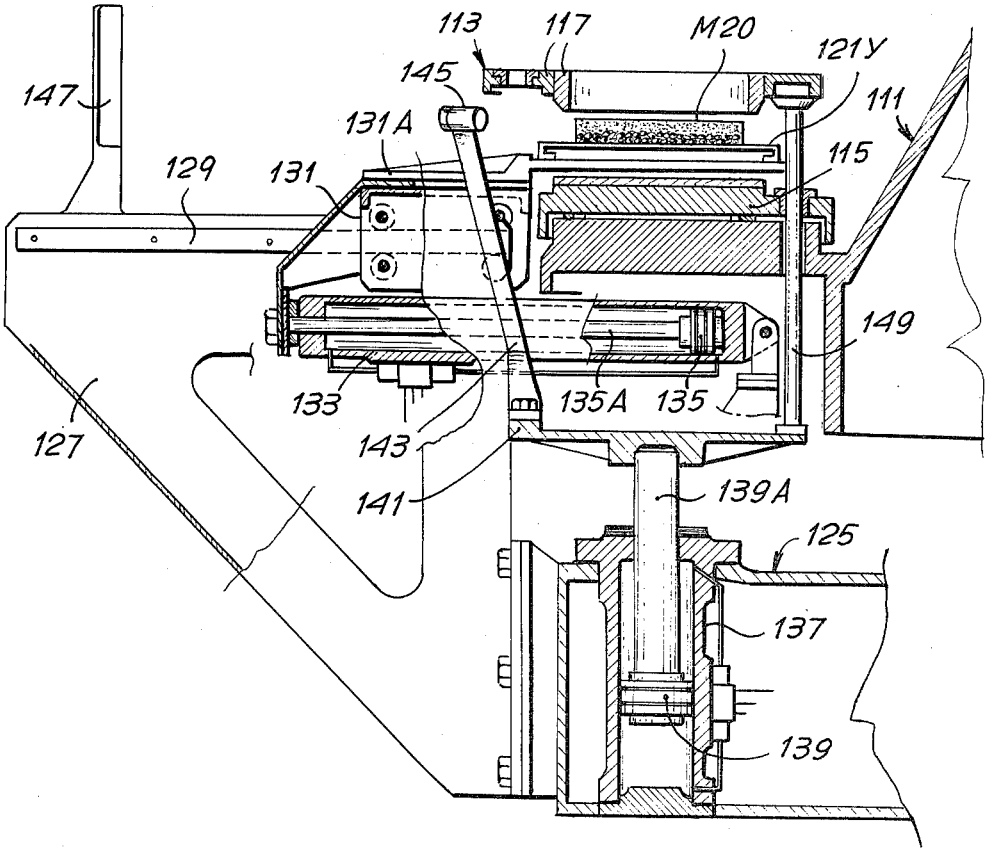
Figure 15A:
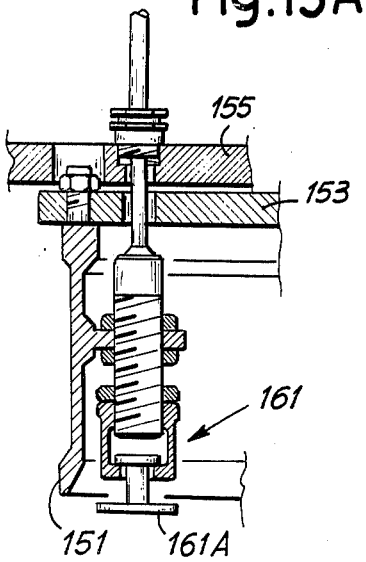
Figure 15:
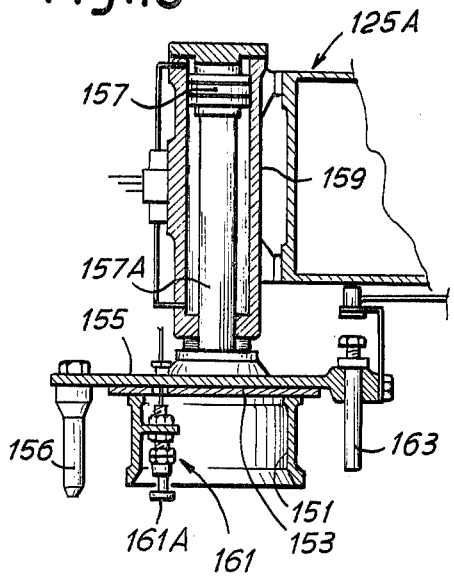
Figure 15:
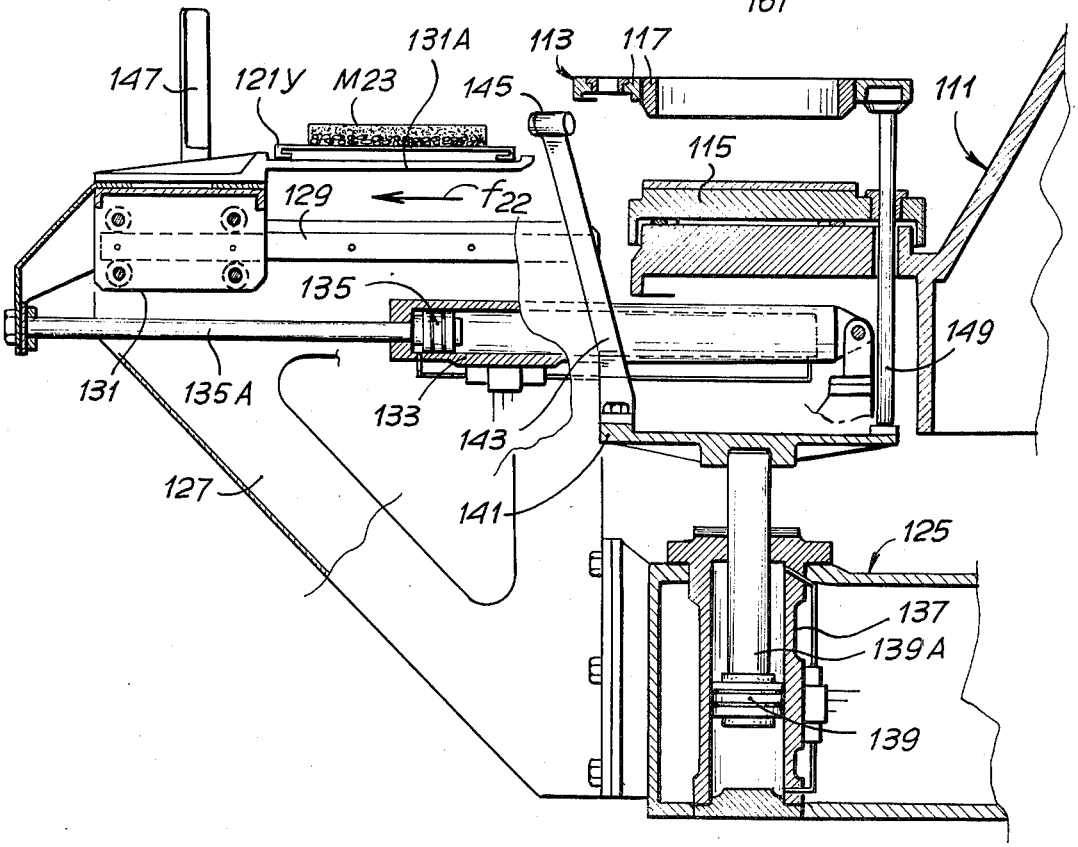

At this time, consent is given for a further raising of piston 139 in the direction of the arrow f20, shown in FIG. 13, and thereby frame 117 is raised sufficiently so that stripping pad 151 effects stripping of the tile which now rests on the surface designed to receive it and brought by carriage 131 under the frame. Raising of frame 117 for stripping is controlled by control system 163, which gives the consent for the subsequent stage of the cycle, represented by the raising of the assembly of stripping pad 151, as shown in FIG. 14, and by retraction of carriage 131 in the direction or arrow f22, as shown in FIG. 15.

Figure 16A:
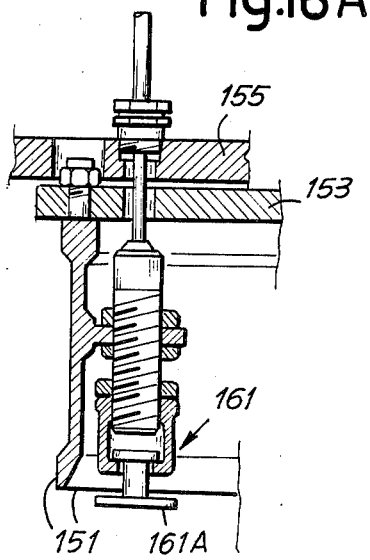
Figure 16:
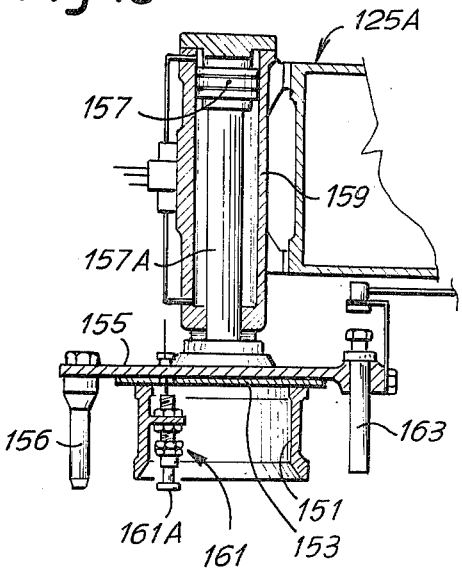
Figure 16:
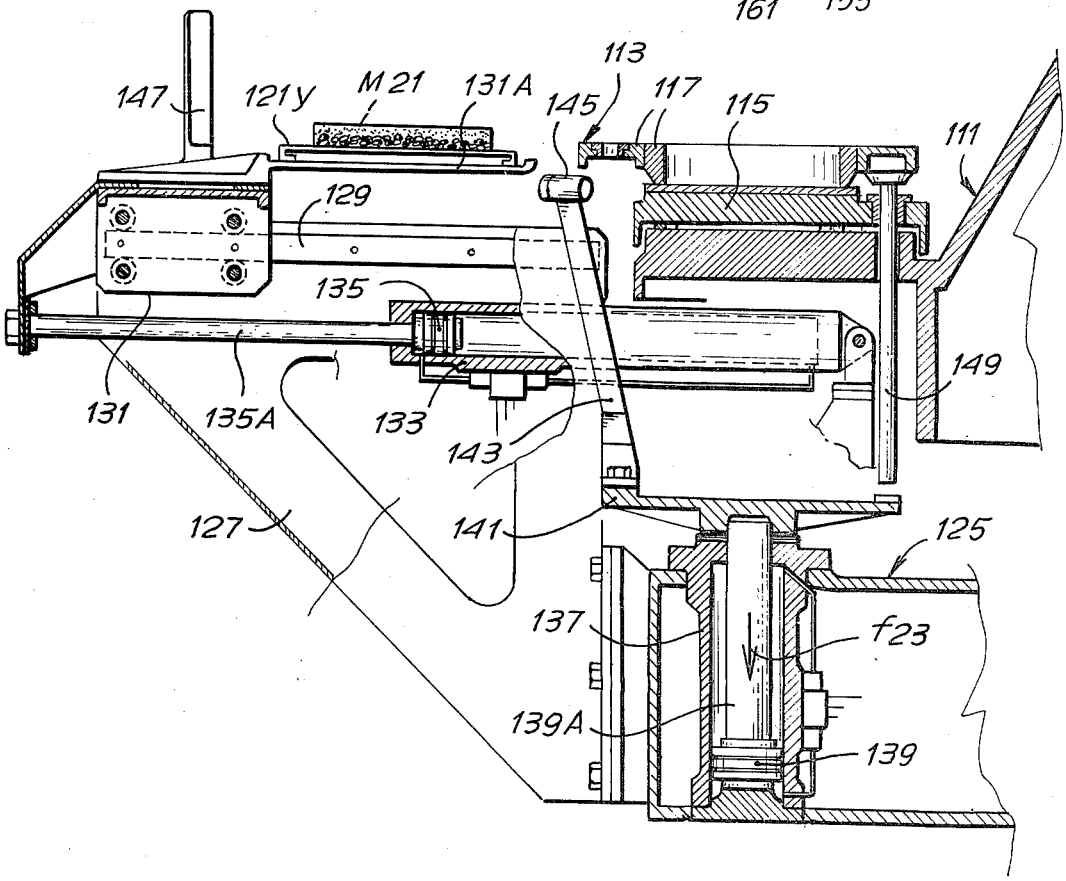
Figure 17A:
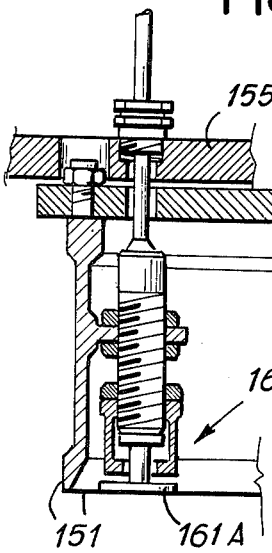
Figure 17:
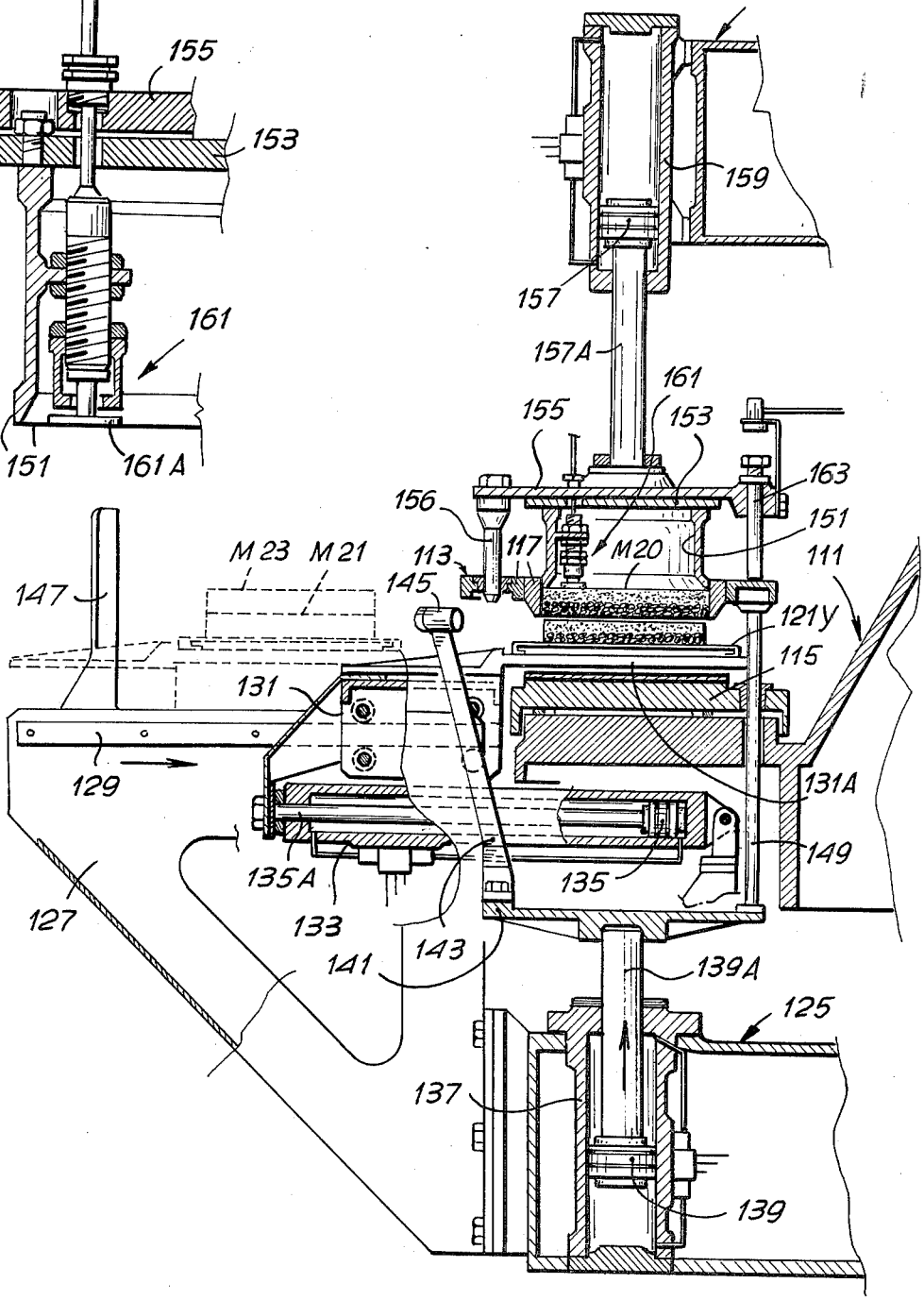

At this time, piston 139 is lowered again in the direction of arrow f23 shown in FIG. 16, and thus the mold returns to the position in which it arrived at the stripping station S7, whereby the rotary table or platform can perform a subsequent advance movement to bring a new mold into stripping station S7 to re-start the cycle.

In the subsequent cycle, the different movements are the same, aside from the degree of raising of frame 117, which latter is established, in this case, not by the level determined by tray **121*y*, but by the level of the upper surface of tile M21 stripped and located on tray 121*y*. The raising of frame 117 takes place, in this case, under the conditions shown in FIG. 17, that is, with an increment in the raising motion relative to the conditions shown in FIG. 10, this increment being equal to the thickness of tile M21 which has previously been stripped. This time also, the stripping pad stops in a position lowered a lesser amount than in the previous case, with respect to the thickness of tile M21, this level being determined again by proximity switch 161. Aside from this, the cycle is repeated under the already described conditions. Thus, when there are two already stripped tiles M21 and M23 on the tray, the raising level of frame 117 will be increased further and this is repeated for all the thicknesses, gradually increased, of the tiles superimposed in the pile on tray 121*y***, up to the limit allowed by the features of the fresh material molded and stripped in the stripping station S7.

It should be noted that, at each angular displacement of the rotary table, tray **121*y* is retracted outside the table and thus each mold reaches stripping station S7 always with frame 117 lowered onto bottom 115 of the respective mold 113 that reaches the stripping station, and each time the frame is raised and the tray is inserted under the frame, with progressive raising as a function of the presence of a progressively increased number of tiles piled up on tray 121*y*. When the pile has reached the predetermined number of tiles, the tray, removed and aligned, as whenever a displacement of the carriage occurs in the direction of arrows f21, with trays 121 and 121X on guides 123, is replaced before a new movement of carriage 131 toward table 111. For this purpose, the row of trays 121, 121*y*, 121X is advanced, and a tray charged with tiles is replaced by a new tray 121 on bracket 131A**, to carry out again the superimposition of more tiles in the pile, in the manner as mentioned.

To advance the row of trays, and thus to replace the tray on carriage 131, 131A, there can be used a counting system adapted to evaluate the number of tiles superimposed as stripped.

With the arrangement thus described, there are obtained synchronous movements and a considerable economy in the times, and especially in the manufacturing costs, of the apparatus, as well as with respect to the sizes of table 111, and which are not increased by the need, which is a feature of prior apparatus, to cause a raising of the frame during movement of the table or in any event before the mold reaches the stripping station. The economy in the number of trays of a plant depends on the number of fresh tiles that can be piled up, and thus on the features of thickness, weight, pressing and composition of the tiles being produced.

While specific embodiments of the invention have been shown and described in detail to illustrate the application of the principles of the invention, it will be understood that the invention may be embodied otherwise without departing from such principles.

What is claimed is:

1. In apparatus for the production of pressed tiles including molds for forming and pressing the tiles, stripping means operable to strip pressed tiles from the molds, respective plates operable to receive and support each stripped tile, and treatment means operable to subsequently treat the tiles supported on the plates, the improvement comprising, in combination, means operable to superimpose plural stripped tiles in at least one pile on each plate solely by moving successively stripped tiles downwardly perpendicular to said plate without horizontal displacement of the tiles; and means operable to move each plate, with at least one pile of stripped tiles supported thereon, to said treatment means.

2. An apparatus as in claim 1, in which each mold is moveable to a stripping position and includes a mold bottom and a frame which can be raised to separate a fresh tile from the mold bottom for stripping of the fresh tile by said stripping means in said stripping position; a respective carriage, including a vertically movable structure for each plate; means on each vertically moveable structure operable to receive a respective plate; and means operable to lower each vertically moveable structure, following positioning of a stripped tile on a plate mounted in the associated receiving means, by an amount equal to the thickness of a single tile.

3. An apparatus as in claim 1, in which said molds are moveable successively to a stripping position, with each mold including a frame which can be raised relative to a mold bottom to lift a fresh tile from the mold bottom in the stripping position; said stripping means including a shovel insertable below a raised frame in said stripping position for receiving a stripped tile; and a transfer tool operable to move each stripped tile from said shovel to a plate to superimpose plural stripped tiles in at least one pile on each plate.

4. An apparatus as in claim 3, in which said transfer tool is a suction device; means supporting said suction device for vertical and linear reciprocation to transfer tiles from said shovel to a plate; and intermediate fender walings on said suction device engageable with the tile to be transported.

5. In apparatus for the production and stripping of pressed cement tiles, including molds moveable into a tile stripping stage and each including a mold bottom and a mold frame which can be raised relative to the mold bottom to separate a fresh tile from the mold bottom for stripping of the fresh tile, stripping pad means engageable with the tile to be stripped to strip the same from the raised frame, and a carriage adapted to mount a stripping plate for receiving plural superimposed stripped tiles and moveable between a position in which the stripping plate is positioned beneath the raised frame of a mold in the tile stripping station and a position in which the stripping plate is retracted from such mold in the tile stripping station, the improvement comprising, in combination, means operable to reciprocate said carriage between said two positions a number of times equal to the number tiles to be stripped and superimposed on one another on a single stripping plate; a vertically moveable assembly, at said stripping station, operable to raise the frame of a mold at said stripping station; means operable to raise said vertically moveable assembly controlled distances as a function of the number of tiles superimposed on a stripping plate in preceding cycles of operation, said means being operable to raise said assembly a fixed further distance to raise the frame of the tile of the mold at the stripping station such fixed distance for stripping of a tile therefrom; a stripping pad engageable with a fresh pressed tile in a raised frame of a mold then at said stripping station; means operable to lower said stripping pad into engagement with a pressed tile in a raised mold frame at said stripping station; a feeler engageable with a pressed tile in a raised mold frame and operable to interrupt lowering movement of said stripping pad responsive to engagement of said feeler with a pressed tile in a raised mold frame irrespective of the level of the raised mold frame; and a consent and control means operable, after a mold has reached said stripping station, to control raising of the mold frame the adjustable distance, insertion of the stripping plate on said carriage beneath the raised mold frame to obtain an optimum stripping condition by fall of the tile from the raised mold frame, lowering of the stripping pad, stripping of the tile from the raised mold frame, subsequent raising of the stripping pad, retraction of the carriage and the stripping tray from the mold in the stripping station, and lowering of the frame of the mold into engagement with the bottom of the mold.

6. An apparatus as in claim 5, comprising a photoelectric cell system cooperable with a reflecting surface to evaluate the level of the supporting surface for a tile about to be stripped from the raised frame of a mold then at said stripping station.

7. An apparatus as in claim 5, including a proximity switch combined with said feeler to effect interruption of the lowering of said stripping pad irrespective of the level to which a mold frame has been raised.

* * * * *